US005688132A

United States Patent [19]

Rogers et al.

[11] Patent Number: 5,688,132

[45] Date of Patent: Nov. 18, 1997

[54] PLUG IN RACEWAY WITH SOCKETLESS RECEPTACLE

[75] Inventors: Wilfred R. Rogers, Bristol; Salvatore A. Cancellieri, Plainville, both of Conn.

[73] Assignee: The Wiremold Company, West Hartford, Conn.

[21] Appl. No.: 639,837

[22] Filed: Apr. 19, 1996

[51] Int. Cl.[6] ..... H01R 25/00

[52] U.S. Cl. ..... 439/120; 439/209; 439/593; 439/139

[58] Field of Search ..... 439/120, 139, 439/209, 216, 593

[56] References Cited

U.S. PATENT DOCUMENTS

| | | | |
|---|---|---|---|
| 2,105,833 | 1/1938 | Feuer et al. | 439/120 |
| 2,673,967 | 3/1954 | Hedgecock | 439/120 |
| 2,781,497 | 2/1957 | Sheskier | 439/120 |
| 4,017,137 | 4/1977 | Parks | 439/209 |

*Primary Examiner*—Neil Abrams
*Assistant Examiner*—T. C. Patel
*Attorney, Agent, or Firm*—McCormick, Paulding & Huber

[57] ABSTRACT

A raceway has extruded polymeric base and cover portions that snap together, and a socket defining segment of the cover can be located anywhere along the base to provide design flexibility for socket location. The base has elongated wire conductors molded into upstanding legs that define self-hinges for resiliently acting on the plug prongs when the plugs are pushed into slots defined by these leg portions. The plug prongs can be used to rotate a safety disk in the cover prior to pushing the prongs into the slots.

36 Claims, 4 Drawing Sheets

PLUG IN RACEWAY WITH SOCKETLESS RECEPTACLE

BACKGROUND OF THE INVENTION

The present invention relates to surface mounted raceways, and deals more particularly with a raceway which includes a base that is adapted to receive an electrical male plug at any point along its length. The base includes a back portion with elongated primary and secondary leg portions integrally connected to the back portion and oriented parallel to one another to define slots therebetween for receiving the conventional prongs of the electrical plug and also for receiving the grounding stud associated with present day electrical plugs. A cover is provided for the raceway base to overlie these outwardly open slots, and at least a portion of the cover preferably defines closable openings designed to be rotated by the plug itself for aligning openings in the cover with the slots in the raceway base.

DESCRIPTION OF THE PRIOR ART

The general concept of providing an elongated member of rubber-like material which defines elongated slots for receiving the spaced prongs of the conventional electrical plug is known in the prior art. Acuff No. 2,108,031 shows slots defined by rather massive but nevertheless flexible side and center portions which permit expansion of the slots so as to facilitate assembly of the wire conductors in grooves that open into these slots. The present disclosure relates instead to a more rigid but nevertheless resilient thermoplastic material which define self-hinges at the juncture between the leg portions and the base. Unlike the Acuff patent disclosure however, the wire conductors are molded into the extruded plastic base itself. The limited resiliency is intended to provide good electrical contact between the prongs of the plug and these electrical conductors which are molded in place.

Another prior art patent to Feuer, et al. U.S. Pat. No. 2,105,833 shows an electrical conduit and outlet combination wherein a pair of elongated slits are provided with electrical conductors in the bottoms of these slits. The molded member of Feuer is not disclosed as resilient however, and is not designed so that the prongs provided on the electrical plug will flex the legs of the base. In Feuer, the plug must have resilient legs that cooperate with tongs on the base to achieve the required pressure for good electrical contact.

In accordance with the present invention, the cover not only serves to prevent access to the slots or slits, but in a unique fashion also serves as a safety device which will require limited rotation of the male plug at a particular location along the cover in order to allow insertion of the plug and to achieve adequate electrical contact between the plug and the conductors in the raceway.

SUMMARY OF THE INVENTION

The general purpose and object of the present invention is to provide an improved raceway system which allows the electrical conductors to be molded or extruded into the base and afford contact with these conductors at any desired point along the base. The base is extruded from a polymeric or plastic material that is significantly stiffer than rubber. The base has upstanding legs which are made flexible by a self-hinge formed in the area of reduced cross section between each of the leg portions and the molded plastic back portion of the base. Limited resilient movement of the leg portions is therefore achieved as the plug is inserted, following which the resilient legs exert a force back on the plug prongs to achieve good electrical contact therebetween.

In its preferred form, the raceway is intended for use with a conventional male plug having two spaced prongs and having a grounding stud each of which is adapted to be received in an associated outwardly open slot provided for this purpose in the extruded polymeric or plastic base. The above-mentioned resiliently flexible hinge lines defined for each of the outwardly or upwardly extending legs assures good electrical contact between the plug prongs and the conductors provided in the extruded base. An extruded plastic cover is also provided for the base to close these outwardly open slots, and to overlie the free ends of the leg portions thereof. A web portion of the cover is adapted to rotatably receive a disk. The disk has openings for receiving the plug prongs. Upon rotation of the disk, these prong openings are aligned with the underlying slots of the base.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DETAILED DESCRIPTION OF THE EMBODIMENTS SHOWN IN FIGS. 1–46

Figure 1:
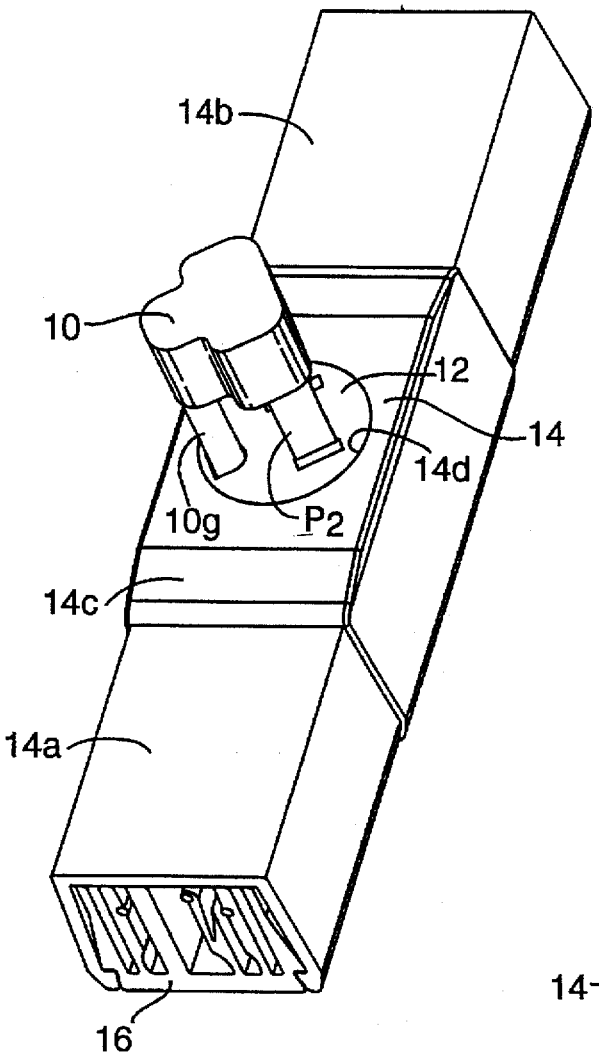
FIG. 1 is a perspective view of a raceway constructed in accordance with the present invention, and also shows a conventional electrical male plug in a preliminary position such that the prongs are aligned with openings in the cover but not yet aligned with the slots defined in the raceway base such that the plug must be rotated slightly prior to being inserted into its active position.

FIG. 1 is a perspective view of a raceway assembly including an extruded raceway base component capable of defining a socketless plug receptacle and elongated extruded covers **14*a* and 14*b*. The raceway base and cover components are extruded from a polymeric or plastic material. Also shown in FIG. 1 is a short cover segment 14 provided in predetermined gaps between the cover sections 14*a* and 14*b*** wherever an electrical female plug receptacle is to be located in the surface mounted raceway installation of the present invention. This cover segment may be injection molded rather than extruded as with the base and cover components.

FIG. 1 shows a preferred embodiment of the present invention and it will be apparent from the description to follow that other configurations will be apparent to a person skilled in the art. The FIG. 1 version is a refinement of the invention that allows the female sockets to be located at any desired location along the raceway. For safety purposes, the user first inserts the plug prongs and then must rotate the plug through a predetermined angle on the order of 30–45 degrees prior to actual insertion of the plug into the extruded raceway base 16 as best shown in FIG. 2.

Figure 2:
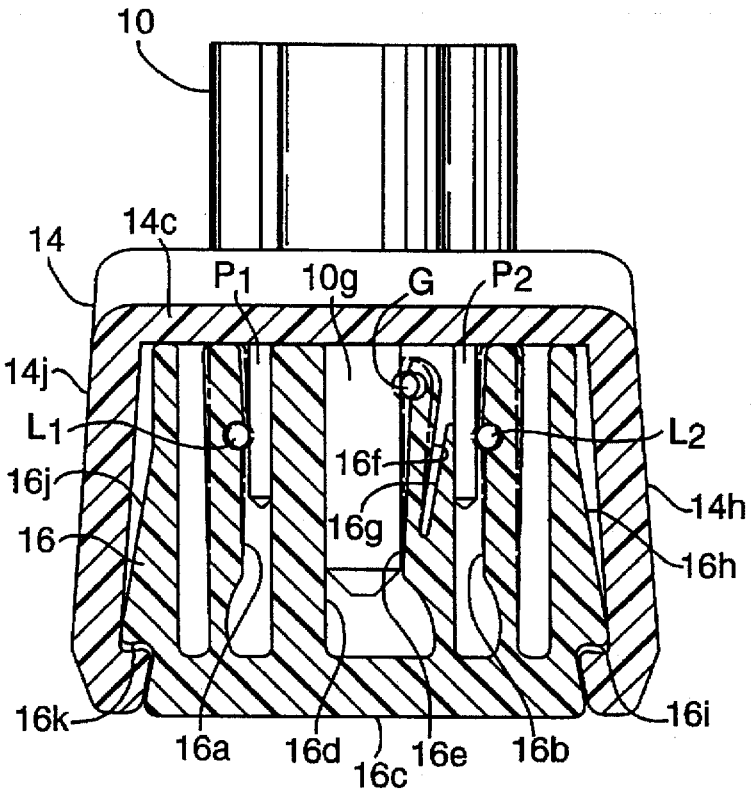
FIG. 2 is a vertical sectional view showing the plug in its active position.

FIG. 2 shows the plug 10 with conventionally configured prongs $P_1$ and $P_2$, received in slots defined between upstanding primary leg portions 16*a* and 16*b* of the base 16. The plug grounding stud 10*g* is received in a central slot defined between secondary leg portions 16*d* and 16*e* of the base 16. The primary leg portions 16*a* and 16*b* cooperate with the secondary leg portions 16*d* and 16*e* to define primary slots for receiving the respective prongs $P_1$ and $P_2$ of the plug 10. Further, each primary leg portion 16*a* and 16*b* is formed during the extrusion process with an elongated conductor $L_1$ and $L_2$ respectfully, in one side of its associated leg portion. Thus, these conductors are securely held in the leg portions 16*a* and 16*b* respectfully. The cylindrically shaped wire conductors $L_1$ and $L_2$ are held in place as a result of the exposed segments thereof comprising significantly less than ½ the circular cross section of the wires. That is, well over ½ of the cylindrical wire is embedded in the plastic leg portion. Although these elongated conductors are shown in the form of wires, it will be apparent that other configurations could be adopted without departing from the spirit and scope of the present invention. For example, these elongated conductors might also comprise strips, and as long as exposed segments of the elongated conductors are arranged to engage the prongs of the plug 10, many of the advantages of the present invention can be realized. The wire shape affords a more practical way to securely hold the conductor in its cavity and to take advantage of the fact that the conductors are molded in place during the extrusion process. In order to provide the necessary restoring force to establish good electrical contact between the elongated conductor $L_1$ and the prong $P_1$ of the plug 10 leg portion 16*a* is provided with an area of reduced cross section adjacent the integral connection between the primary leg portion 16*a* and the base back portion 16*c* of the base 16 to define a self-hinge line that is oriented parallel to the longitudinal direction defined by the elongated raceway base. The width of these slots in the base when the leg portions are not resiliently flexed by the plug prongs is shown in FIG. 2 in phantom lines. Obviously, when flexed apart, these slots are wide enough to receive the plug prongs and to assure good electrical contact with the wires $L_1$ and $L_2$ by reason of this resilient flexing of leg portions 16*a* and 16*b*.

It is a further feature of the present invention that the slots provided in the base for receiving the prongs $P_1$ and $P_2$ of the plug 10 are further defined by secondary leg portions 16*d* and 16*e*, which secondary leg portions also define the slot for receiving the grounding plug stud 10*g*. The secondary leg portions 16*d* and 16*e* also cooperate with the primary leg portions 16*a* and 16*b* to define the slots for receiving the electrically conductive prongs $P_1$ and $P_2$ of the plug 10.

At least one of these secondary leg portions, as shown the portion 16*e*, also defines a hinge line adjacent the juncture between it and the base back portion 16*c* so as to afford limited resiliency between this leg portion 16*e* and its opposing secondary leg portion 16*d*. This construction provides for resilient flexing of this secondary leg portion 16*e* in order to better receive grounding stud 10*g* of the plug 10, and hence assure good electrical contact between it and the elongated grounding conductor G that is provided in this upstanding secondary leg 16*e*. The secondary leg portion 16*e* should also be somewhat flexible and resilient relative to the primary leg portion 16*b*, or at least relative to the slot between them, so that flexing of this leg portion 16*e* toward the leg portion 16*b* does not preclude entry of the plug prong $P_2$ into this slot. In order to assure that any such interference is avoided, the upper edge of leg portion 16*e* is preferably forked or bifurcated such that a shallow V-shaped valley allows flexing of the longer side 16*f* adjacent the grounding plug stud 10*g*, while the shorter side 16*g* of the V-shaped valley is not flexed, at least until the plug prong $P_2$ has moved downwardly between leg portions 16*e* and 16*b*, as suggested in FIG. 2. The elongated grounding conductor G is provided in the longer side of the secondary leg portion 16*e* and has a segment exposed in the same manner as that provided for supporting the elongated conductors $L_1$ and $L_2$ in the primary leg portion 16*a* and 16*b* respectively. However, and as best shown in FIG. 2, the grounding conductor G is provided close to the free end portion of this secondary leg portion in order to establish contact between it and the grounding stud 10*g* prior to contact between the conductors $L_1$ and $L_2$ and the prongs $P_1$ and $P_2$ respectfully. This design feature is dictated by the requirement that the grounding stud of a conventional male plug make contact with ground prior to electrical energy being established at the prongs $P_1$ and $P_2$ of such a plug. Most conventional plugs, such as that indicated in the drawings, will have a grounding stud 10*g* that is somewhat longer than the prongs $P_1$ and $P_2$ of the plug 10 for this reason.

Still with reference to FIG. 2, the elongated extruded base 16 is preferably fitted with a short cover or cover segment 14 such that the cover provides electrical isolation of the conductors $L_1$ and $L_2$, and such that the overall appearance of the resulting raceway is rendered more aesthetically acceptable after installation. Thus, the cover 14 is of generally inverted U-shape in cross section and includes depending cover sidewalls 14*h* and 14*j* together with an integrally formed web portion of the cover as indicated generally at 14*c*. The web portion overlies the free end portions of the primary and secondary leg portions, and it is further noted that the depending cover sidewall portions also overlie upstanding base sidewalls 16*h* and 16*j*. These upstanding sidewalls 16*h* and 16*j* of the base 16 serve to further isolate the conductors $L_1$ and $L_2$, and to define abutments 16*i* and 16*k* which cooperate with oppositely configured abutments on the free end portions of the sidewalls 14*b* and 14*j* of the cover 14 for securing the raceway components in assembled relationship. Thus, the sidewalls 14*h* and 14*j* of cover 14 are adapted to flex resiliently outwardly to facilitate assembly of the cover with the base, and to provide a secure configuration for the resulting raceway after assembly.

It will be apparent that without the cover segment 14 and prior to assembly of the cover sections 14*a* and 14*b* with the base 16, that a conventional male plug such as that illustrated at 10 can be inserted randomly along the raceway base so that the plug prongs achieve electrical contact with the conductors $L_1$ and $L_2$, and the stud with grounding conductor G, as required to transmit electrical energy to the plug 10. This is an important function of the invention, that is to afford the installer flexibility in plug placement along the raceway. The installer may provide cover segments 14, 14 at any convenient location, and to place elongated cover segments 14a and 14b over the base where no need for a socket outlet is anticipated.

Figure 3:
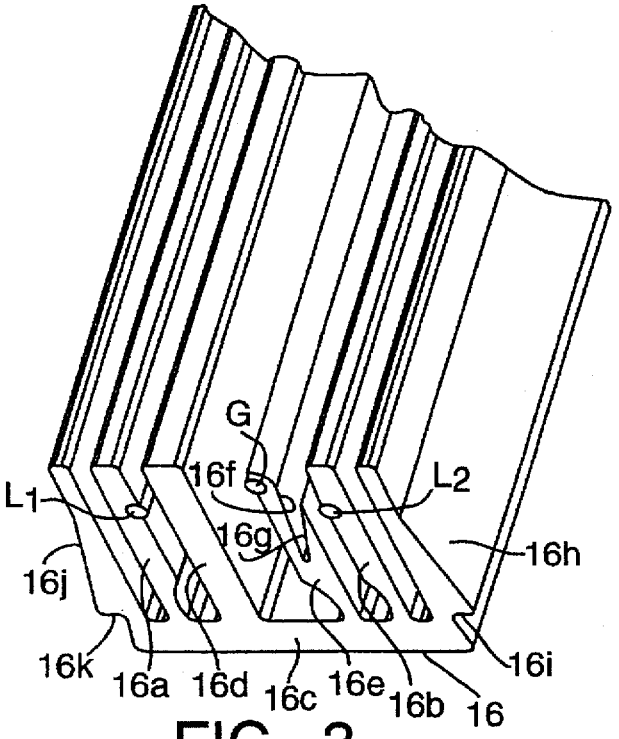
FIG. 3 is a perspective view of the raceway base, prior to assembly with the covers of FIGS. 1 and 2.

Thus, it is a feature of the present invention that a plug can be readily accommodated anywhere along the raceway base portion 16. Only those portions of the raceway that are to be designated as a receptacle for the socketless base need be provided with a cover segment as illustrated at 14 in FIG. 1. FIG. 3 shows the raceway base portion 16 without any cover segments placed upon it. The base 16 is shown as it would appear prior to attachment to a wall structure. The central grounding slot defined between the secondary leg portions of the base 16, has fastener openings (not shown) for receiving fasteners to attach the raceway base to a wall structure. After such a first installation step and after consideration given to the locations where a receptacle is to be provided on the raceway base 16, covers 14a and 14b can be secured to the base as described previously, and socket defining covers 14 at the locations where a socket is to be provided for on the raceway base 16.

Figure 1B:
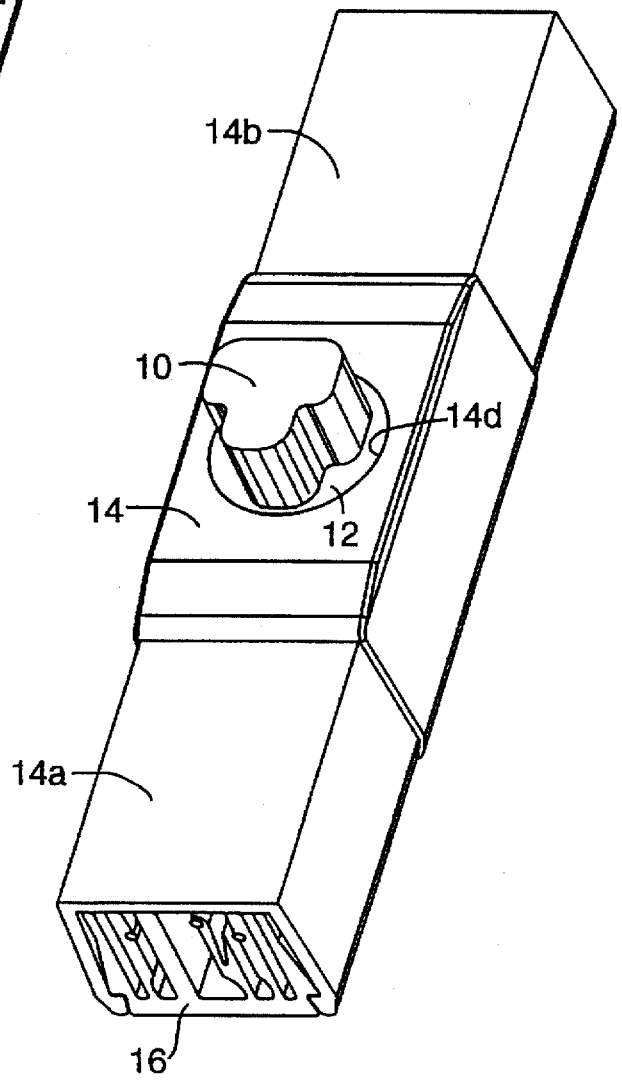
FIG. 1B is a view similar to FIG. 1, but with the plug in its active position.
Figure 1A:
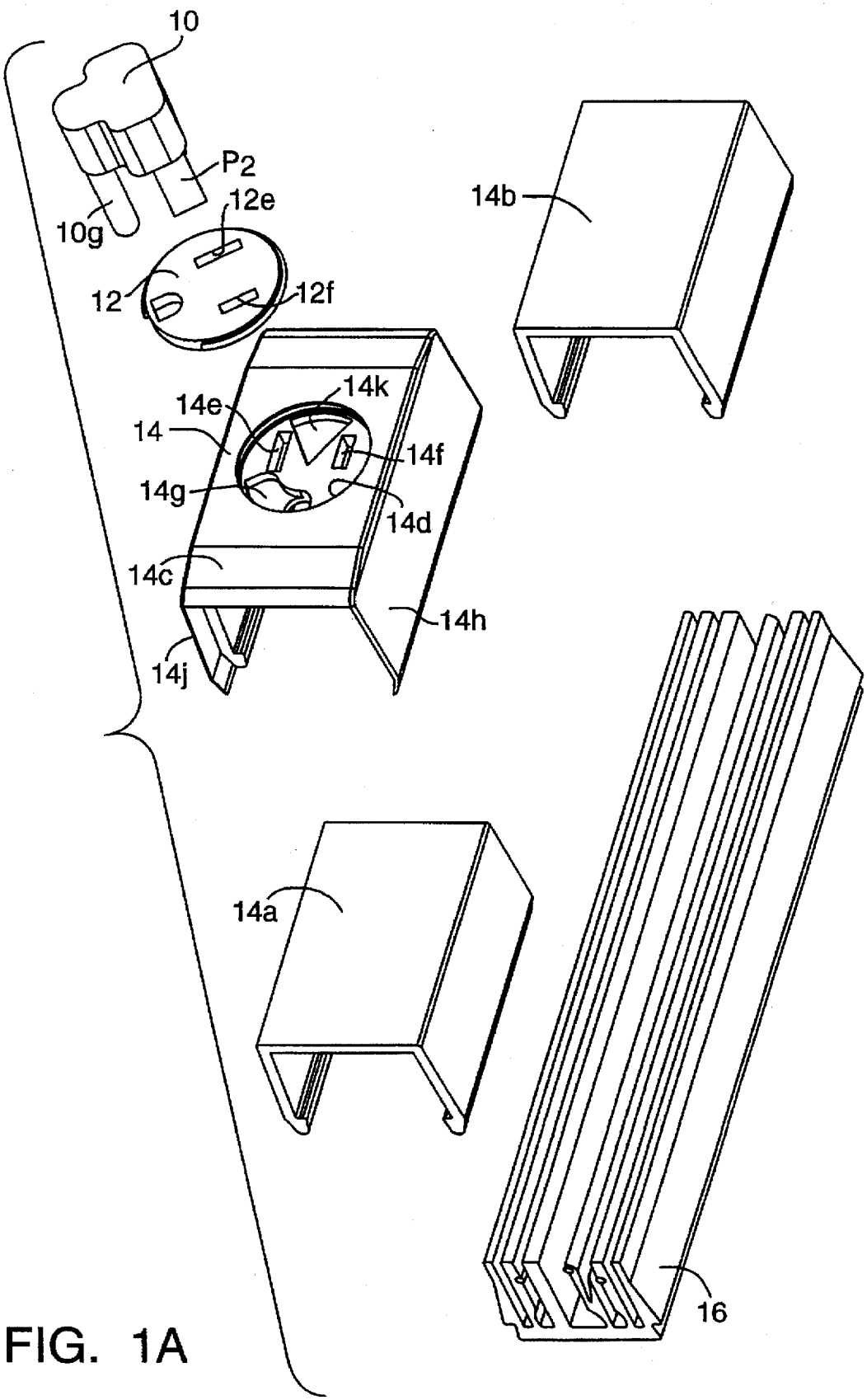
FIG. 1A is an exploded view of the component, shown in FIG. 1.
Figure 4:
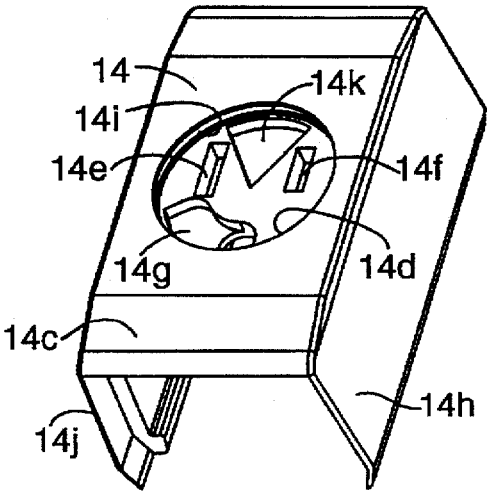
FIG. 4 is a perspective view of the cover shown in FIG. 2.
Figure 5:
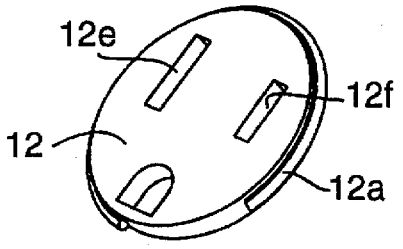
FIG. 5 is a perspective view of the disk which is rotatably received in the opening of the cover shown in FIG. 4.

Considering FIGS. 4 and 5 in greater detail, the cover 14 is shown as including not only the web portion 14c and integrally connected cover sidewall portions 14h and 4j, but also as including an integrally formed thickened center portion that defines an outwardly open circular recess 14d, the bottom wall of which recess defines further openings, as indicated generally at 14e and 14f, adapted to receive the prongs $P_1$ and $P_2$ of the male plug 10. The slots 14e and 14f in the circular recess 14d of the cover segment 14 in FIG. 4 are aligned with the underlying slots in the raceway base defined between the elongated primary and secondary leg portions described previously. A grounding stud opening 14g is aligned with the center slot provided for the grounding stud 10g. Since this stud 10g is somewhat longer than the prongs $P_1$ and $P_2$ on the male plug which carry the electrical energy as described previously, a recess in this grounding plug opening 14g is provided which will allow rotation of the plug around an axis oriented vertically with respect to the web portion 14c of the cover 14 and with respect to the orientation of the plug 10 in FIG. 1. As shown in FIG. 1, the plug 10 must be preliminarily oriented as shown to align the plug prongs with prong openings in a circular disk 12 or movable portion of the cover 14, provided in the circular opening 14d. Abutments on the disk 12 (FIG. 5) afford a convenient means for limiting angular rotation of the disk and hence the plug from the position shown for it in FIG. 1 to that shown for it in FIG. 1B. The disk of FIG. 5 provides for limited insertion of the plug prongs into the various openings of the disk as a result of which the disk and the plug can be rotated so as to align the plug prongs with the openings 14e and 14f in the cover of FIG. 4. Only when the disk 12 of FIG. 5 has its slots 12e and 12f aligned with the slots 14e and 14f of the cover web portion will the plug prongs be insertable into the slots provided in the raceway base to achieve electrical connection with the lines or conductors $L_1$ and $L_2$.

The disk 12 includes an annular or peripheral rib 12a which is adapted to be received in a groove 14i provided for this purpose in the opening 14d of the cover segment 14. As so constructed the disk 12 is rotatable in this opening of the cover portion. Abutments at the ends of this peripheral rib 12a are adapted to engage a fixed abutment provided for this purpose in the circular opening of 14d of the cover portion so as to limit the angular rotation of the disk 12 to approximately the angular range referred to previously. In fabricating the various components of the raceway described above, it will be apparent that the cover sections 14a and 14b as well as the elongated raceway base are preferably fabricated in an extrusion process which preferably provide for the conductors $L_1$, $L_2$ and G to be molded in their respective grooves in a very economical matter. The cover 14 is then "randomly" located along the extruded base to provide for the "socketless" connection with the conductors in the base. The cover 14 may be fabricated in an injection molding process because the cover 14 is not of uniform cross section, but is provided with the safety feature of requiring limited rotation of the plug relative to this cover prior to insertion of the plug into position for establishing electrical contact with the conductors of the base.

Figure 5A:
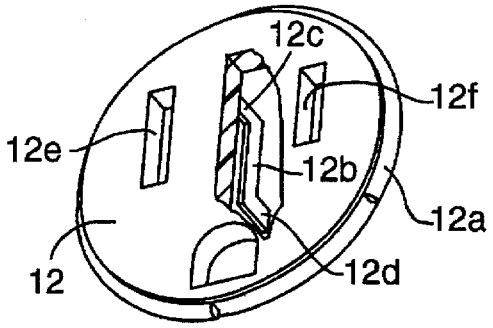
FIG. 5A is another view of the disk shown in FIG. 5, but with the center portion broken away to show an integrally molded return spring.

As shown in FIG. 5A, this disc 12 has a torsional leaf spring 12b with one end 12c secured (as by being integrally molded of the same polymeric material as the disc) to the underside of the disc. The spring 12b has a free end 12d which acts against the side of opening 14k in cover 14 to urge the disc toward its inactive (FIG. 1) position.

Figure 6:
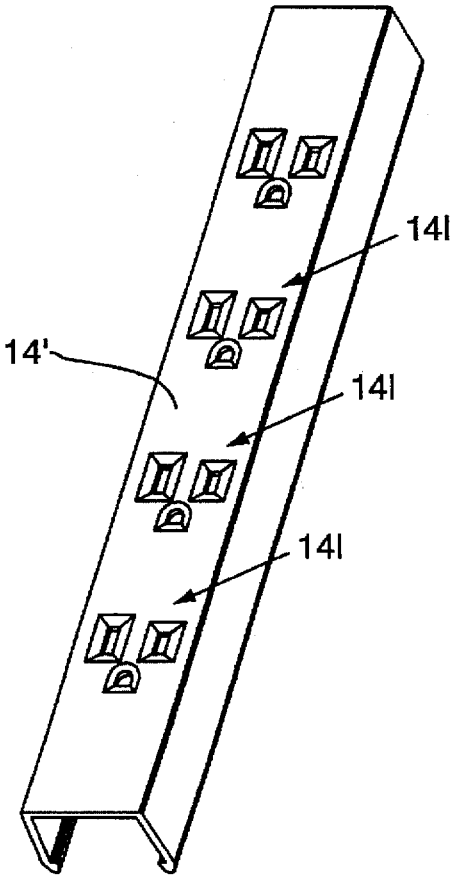
FIG. 6 is a perspective view of a cover that is of slightly different configuration.
Figure 6A:
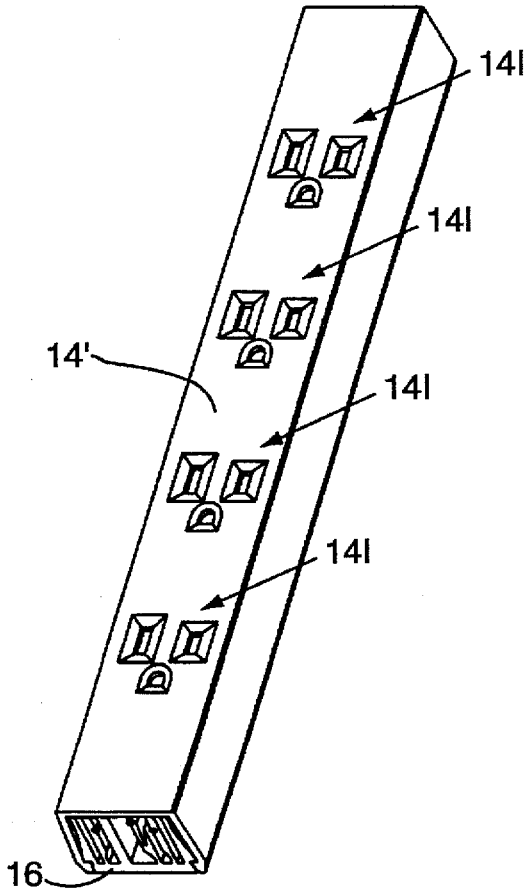
FIG. 6A is a perspective view of the FIG. 6 cover on the base of FIG. 3.

Alternatively, the cover 14 might be fabricated in much the same manner as the cover sections 14a and 14b and with the openings 14e and 14f for receiving the male plug prongs $P_1$ and $P_2$. Such a simplified structure would not require the rotation of plug 10 prior to insertion of the plug into the raceway socket. FIG. 6 shows such a cover wherein a plurality of socket openings 14l are provided in the cover 14'. FIG. 6A shows cover 14' of FIG. 6 mounted on the base 16 of FIG. 3.

Other variations of the present invention will occur to those skilled in this particular art. The invention has been defined in the appended claims, which claims are also to be interpreted as encompassing equivalents to the various limitations presented provided only that these equivalents accomplish substantially the same function in substantially the same way to achieve substantially the same result.

We claim:

1. In a raceway for use with an electrical male plug having at least two spaced prongs and a grounding plug stud, said raceway comprising an elongated raceway base of non conductive extruded plastic, said base including a back portion and elongated primary leg portions oriented generally parallel to one another said primary elongated leg portions integrally connected to said back portion along elongated resiliently flexible hinge lines, electrical conductors molded into said primary elongated leg portions and arranged between said hinge lines and the free ends of said leg portions, said conductors having elongated exposed segments projecting laterally of said primary leg portions and being spaced from one another so that said primary leg portions flex laterally to assure electrical contact between the plug prongs and said elongated electrical conductors, said elongated raceway base including entegrally formed secondary leg portions oriented parallel to one another and defining an elongated secondary slot between them for receiving the grounding plug stud of the male electrical plug, and an elongated electrical grounding conductor molded into at least one of said secondary leg portions, said electrical grounding conductor having an exposed segment projecting laterally into said secondary slot to provide electrical contact between the grounding plug stud and said elongated electrical grounding conductor.

2. The raceway according to claim 1, wherein said at least one of said secondary leg portions has a free end portion that is initially flexible on an auxiliary hinge line whereby said secondary leg portion undergoes preliminary lateral flexing upon initial insertion of said grounding plug stud.

3. The raceway according to claim 1, wherein said at least one of said secondary leg portions is integrally connected to said raceway back portion along an elongated resiliently flexible secondary hinge line whereby the grounding plug stud pushes laterally against said electrical grounding conductor to assure electrical contact between the grounding stud and said electrical grounding conductor.

4. The raceway according to claim 1, further characterized by an extruded plastic cover for said base, said cover being generally U-shaped in cross section with a web portion adapted to overlie the free ends of said primary leg portions, and said extruded plastic cover including spaced sidewalls integrally connected to said web portion thereof, said sidewalls of said cover having free ends defining abutments that mate with abutments defined on said base in order to hold said cover and base in assembled relationship to one another.

5. The raceway according to claim 4, wherein said base includes upstanding base sidewalls which are received inside said cover sidewalls, said abutments on said cover sidewall free end portions projecting inwardly to engage said abutments on said base sidewalls.

6. The raceway according to claim 3, further characterized by a pair of elongated primary slots defined between said primary and secondary leg portions, said pair of primary slots being spaced apart to receive the male plug prongs.

7. The raceway according to claim 6, wherein said at least one of said secondary leg portions has a free end portion that is initially flexible on an auxiliary hinge line whereby said secondary leg portion undergoes preliminary lateral flexing upon initial insertion of said grounding plug stud.

8. The raceway according to claim 3, wherein said secondary leg portion has a free end portion opposite said secondary hinge line, that is initially flexible on an auxiliary hinge line parallel said secondary hinge line whereby said secondary leg portion undergoes initial lateral flexing upon initial insertion of said grounding plug stud without substantially flexing of said secondary leg portion about said secondary hinge line.

9. The raceway according to claim 8, wherein said at least one secondary leg portion is more particularly defined by upper edges defining a valley therebetween, said valley being angled with respect to the direction of insertion of said plug prongs so as to create an area of reduced thickness in the said at least one secondary leg portion midway between said secondary hinge line at the base of said secondary leg portion and the location of said grounding conductor.

10. In a raceway for use with an electrical male plug having at least two spaced prongs, said raceway comprising an elongated raceway base of non conductive extruded plastic, said base including a back portion and elongated primary leg portions oriented generally parallel to one another, said primary elongated leg portions integrally connected to said back portion along elongated resiliently flexible hinge lines, electrical conductors molded into said primary elongated leg portions and arranged between said hinge lines and the free ends of said leg portions, said conductors having elongated exposed segments projecting laterally of said primary leg portions and being spaced from one another so that said primary leg portions flex laterally to assure electrical contact between the plug prongs and said elongated electrical conductors, a cover segment for said base, said cover segment being generally U-shaped in cross-section with a cover segment web portion adapted to overlie the free ends of said primary leg portions, and said cover segment having cover segment side walls with portions that mate with said leg portions of said base, said cover segment web portion defining openings for receiving the male prongs of the plug, said cover segment further includes a moveable portion in said web portion thereof, said movable portion having a blocking position to prevent said openings from so receiving the prongs of the male plug.

11. The raceway according to claim 10, wherein said movable portion of said cover segment also has an active position wherein said openings are not blocked whereby to the receive prongs of the male plug.

12. The raceway according to claim 10, further characterized by elongated integrally formed secondary leg portions oriented parallel to and spaced laterally from said primary elongated leg portions to define at least one pair of elongated primary slots therebetween, said pair of primary slots spaced apart to receive the male plug prongs.

13. The raceway according to claim 12, wherein said at least one of said secondary leg portions has a free end portion that is initially flexible on an auxiliary hinge line whereby said secondary leg portion undergoes preliminary lateral flexing upon initial insertion of the grounding plug stud.

14. The raceway according to claim 10, further comprising means for biasing said movable portion of said web portion toward said blocking position.

15. The raceway according to claim 14, wherein said biasing means comprises a leaf spring having one end secured to the underside of said movable portion and having a free end portion engageable with said web portion.

16. The raceway according to claim 11, further comprising means for biasing said movable portion of said web portion toward said blocking position.

17. The raceway according to claim 16, wherein said biasing means comprises a leaf spring having one end secured to the underside of said movable portion and having a free end portion engageable with said web portion.

18. The raceway according to claim 11, wherein said movable portion of said raceway cover segment comprises a disk rotatably received in said web portion of said cover segment, said disk defining spaced disk openings that are aligned with said openings in said web portion of said cover segment at least in the active position of said disk, said spaced disk openings being blocked by said web portion in the blocked position, and said active and blocked positions of said disk being angularly spaced from one another.

19. The raceway according to claim 18, further comprising means for biasing said movable portion of said web portion toward said blocking position.

20. The raceway according to claim 19, wherein said biasing means comprises a leaf spring having one end secured to the underside of said movable portion and having a free end portion engageable with said web portion.

21. The raceway according to claim 20, wherein said movable disc portion of said web is integrally molded of polymeric material and wherein said leaf spring is also of polymeric material.

22. In a raceway for use with an electrical male plug having at least two spaced prongs, said raceway comprising an elongated raceway base of non conductive extruded plastic, said base including a back portion and elongated primary leg portions oriented generally parallel to one another, said primary elongated leg portions integrally connected to said back portion along elongated resiliently flexible hinge lines, electrical conductors molded into said primary elongated leg portions and arranged between said hinge lines and the free ends of said leg portions, said conductors having elongated exposed segments projecting laterally of said primary leg portions and being spaced from one another so that said primary leg portions flex laterally to assure electrical contact between the plug prongs and said elongated electrical conductors, a cover segment for said base, said cover segment being generally U-shaped in cross-section with a cover segment web portion adapted to overlie the free ends of said primary leg portions, and said cover segment having cover segment side walls with portions that mate with said leg portions of said base, said cover segment web portion defining openings for receiving the male prongs of the plug, said base including elongated integrally formed secondary leg portions oriented parallel to one another and defining an elongated secondary slot between them for receiving a grounding plug stud of the male electrical plug, and an elongated electrical grounding conductor molded into at least one of said secondary leg portions, said electrical grounding conductor having an exposed segment projecting laterally into said secondary slot to provide electrical contact between the grounding plug stud and said elongated electrical grounding conductor.

23. The raceway according to claim 22, wherein said cover web portion defines a plurality of openings for receiving the prongs of a plurality of electrical plugs, whereby the electrical prongs of these plugs are received in said primary slots for electrical engagement with said conductors.

24. The raceway according to claim 22, wherein said at least one of said secondary leg portions is integrally connected to said raceway back portion along an elongated resiliently flexible secondary hinge line whereby the grounding plug stud pushes laterally against said electrical grounding conductor to assure electrical contact between the grounding stud and said electrical grounding conductor.

25. The raceway according to claim 24, wherein said secondary leg portion has a free end portion opposite said secondary hinge line, that is initially flexible on an auxiliary hinge line parallel said secondary hinge line whereby said secondary leg portion undergoes initial lateral flexing upon initial insertion of said grounding stud without substantially flexing of said secondary leg portion about said secondary hinge line.

26. The raceway according to claim 24, the raceway according to claim 4, further characterized by a pair of elongated primary slots defined between said primary and secondary leg portions, said pair of primary slots being spaced apart to receive the male plug prongs.

27. The raceway according to claim 26, wherein said secondary leg portion has a free end portion opposite said secondary hinge line, that is initially flexible on an auxiliary hinge line parallel said secondary hinge line whereby said secondary leg portion undergoes initial lateral flexing upon initial insertion of said grounding stud without substantially flexing of said secondary leg portion about said secondary hinge line.

28. In a raceway for use with an electrical male plug having at least two spaced prongs, said raceway comprising an elongated raceway base of non conductive extruded plastic, said base including a back portion and elongated primary leg portions oriented generally parallel to one another, said primary elongated leg portions integrally connected to said back portion along elongated resiliently flexible hinge lines, electrical conductors molded into said primary elongated leg portions and arranged between said hinge lines and the free ends of said leg portions, said conductors having elongated exposed segments projecting laterally of said primary leg portions and being spaced from one another so that said primary leg portions flex laterally to assure electrical contact between the plug prongs and said elongated electrical conductors, in the cover segment for said base, said cover segment being laterally U-shaped in cross-section with a cover segment web portion adapted to overlie the free ends of said primary leg portions, and said cover segment having cover segment side walls with portions that mate with said leg portions of said base, said cover segment web portion defining openings for receiving the male prongs of the plug, an extruded plastic cover for said base, said cover being generally U-shaped in cross section with a web portion adapted to overlie the free ends of said primary leg portions, and said extruded plastic cover including spaced sidewalls integrally connected to said web portion thereof, said sidewalls of said cover having free ends defining abutments that mate with abutments defined on said base in order to hold said cover and base in assembled relationship to one another.

29. The raceway according to claim 28, wherein said cover web portion defines a plurality of openings for receiving the prongs of a plurality of electrical plugs, whereby the electrical prongs of these plugs are received in said primary slots for electrical engagement with said conductors.

30. The raceway according to claim 28, wherein said base includes upstanding base sidewalls which are received inside said cover sidewalls, said abutments on said cover sidewall free end portions projecting inwardly to engage said abutments on said base sidewalls.

31. The raceway according to claim 30, wherein said cover web portion defines a plurality of openings for receiving the prongs of a plurality of electrical plugs, whereby the electrical prongs of these plugs are received in said primary slots for electrical engagement with said conductors.

32. The raceway according to claim 30, wherein said cover segment further includes a moveable portion in said web portion thereof, said movable portion having a blocking position to prevent said openings from so receiving the prongs of the male plug.

33. The raceway according to claim 32, wherein said movable portion of said cover segment also has an active position wherein said openings are not blocked whereby to receive the prongs of the male plug.

34. The raceway according to claim 33, wherein said movable portion of said raceway cover segment comprises a disk rotatably received in said web portion of said cover segment, said disk defining spaced disk openings that are aligned with said openings in said web portion of said cover segment at least in the active position of said disk, said spaced disk openings being blocked by said web portion in the blocked position, and said active and blocked positions of said disk being angularly spaced from one another.

35. The raceway according to claim 34, wherein said at least one of said secondary leg portions has a free end portion that is initially flexible on an auxiliary hinge line whereby said secondary leg portion undergoes preliminary lateral flexing upon initial insertion of said grounding plug stud.

36. The raceway according to claim 35, wherein said auxiliary hinge line is defined in said area of reduced cross-sectional thickness between said grounding conductor and said secondary hinge line.

* * * * *

UNITED STATES PATENT AND TRADEMARK OFFICE

CERTIFICATE OF CORRECTION

PATENT NO. : 5,688,132

DATED : November 18, 1997

INVENTOR(S) : Wilfred R. Rogers and Salvatore A. Cancellieri

It is certified that error appears in the above-indentified patent and that said Letters Patent is hereby corrected as shown below:

Column 4, Line 52, "14b" should be "14h".

Column 5, Line 47, insert --12-- after "disk".

Column 6, Line 51, "entegrally" should be "integrally".

Column 9, Line 34, insert --plug-- after "grounding".

Column 9, Lines 37 and 38, delete "the raceway according to claim 4".

Signed and Sealed this

Twenty-fourth Day of March, 1998

*Attest:*

Bruce Lehman

BRUCE LEHMAN

*Attesting Officer*

*Commissioner of Patents and Trademarks*